United States Patent [19]

Inoue

[11] Patent Number: 5,000,424

[45] Date of Patent: Mar. 19, 1991

[54] VEHICLE JACK

[75] Inventor: Tetsuo Inoue, Handa, Japan

[73] Assignee: Sugiyasu Industries Co., Ltd., Takahama, Japan

[21] Appl. No.: 482,832

[22] Filed: Feb. 21, 1990

[30] Foreign Application Priority Data

Feb. 23, 1989 [JP] Japan ..... 1-20740

[51] Int. Cl.[5] ..... B66F 3/24

[52] U.S. Cl. ..... 254/93 H

[58] Field of Search ..... 254/93 H, 93 R, 2 R, 254/2 B, 2 C; 92/108, 17, 18, 107, 117 R, 23; 60/477; 188/151 A, 67; 187/8.47, 8.49

[56] References Cited

U.S. PATENT DOCUMENTS

| | | | |
|---|---|---|---|
| 2,284,958 | 6/1942 | Grime | 254/93 H |
| 3,647,183 | 3/1972 | Rishoud | 254/2 B |
| 3,824,861 | 7/1974 | Goebel | 254/93 H |
| 4,174,095 | 11/1979 | Chipman | 254/93 H |
| 4,641,815 | 2/1987 | Yu | 254/93 H |
| 4,865,293 | 9/1989 | Ishi | 254/2 R |

FOREIGN PATENT DOCUMENTS

| | | |
|---|---|---|
| 28200 | 1/1990 | Japan . |
| 111679 | 4/1989 | Japan . |
| 286599 | 3/1990 | Japan . |

*Primary Examiner*—Robert C. Watson
*Attorney, Agent, or Firm*—LaHive & Cockfield

[57] ABSTRACT

A vehicle jack comprises a base with means for moving the jack smoothly on a ground, an upright shell located on the base, an upright hydraulic ram located inside the shell and including a cylinder construction and a hollow rod, a vehicle support for directly supporting the bottom of a vehicle to be jacked up, a hydraulic source for raising the cylinder construction, and a locking means for mechanically preventing the cylinder construction from lowering from a raised position. The cylinder construction may include an outer cylindrical wall, an intermediate, slidable cylindrical wall capable of being extended upwardly from the rest of the cylinder construction and having openings through any one of which a pin may be inserted to fix the intermediate cylindrical wall at a required height, and an inner cylindrical wall defining an inner cylinder chamber. The hollow rod is located inside the inner cylindrical wall, and is fixed to the base at its bottom and defines an inner oil path which is in communication with the cylinder chamber. The hydraulic source is in communication with the oil path and supplies a hydraulic oil through the oil path into the cylinder chamber to raise the cylinder construction to lift up a vehicle with the vehicle support. The locking means, for example, may comprise a thread formed on an outer circumference of the outer cylindrical wall of the cylinder construction and an annular stopper provided around the outer cylindrical wall and having at an inner surface thereof a thread which is in engagement with the thread on the outer cylindrical wall.

4 Claims, 8 Drawing Sheets

VEHICLE JACK

FIELD OF THE INVENTION

This invention relates to a vehicle jack, and more particularly relates to a device for jacking up a vehicle of relatively heavy weight.

BACKGROUND OF THE INVENTION

Conventionally, to repair a vehicle of heavy weight, a relatively small-sized jacking device such as a garage jack G (FIG. 5(*a*)) or a frame lift F (FIG. 5(*b*)) is used where a large-sized jacking device, such as one including a scissors jack, is unavailable. One can lift a vehicle only to a relatively small height with a garage jack. Also, a garage jack is positioned to lift the center of the width of the front or rear part of the vehicle bottom, as shown in FIG. 5(*a*). Therefore, if one uses a garage jack, he cannot work freely under the center of the width of the vehicle bottom. Thus, if one uses a garage jack to replace the oil, he must first lift the vehicle with the garage jack and then support opposed sides of the vehicle bottom with suitable means and remove the garage jack. It takes much time and trouble. In addition, it may be very dangerous to lift a vehicle for a long period of time only with a garage jack. To lift a vehicle for a long period of time, suitable means should be used to support opposed sides of the vehicle bottom. A frame lift must be moved under a vehicle from the front or the rear of the vehicle. Therefore, if the vehicle has a guard A located at a relatively low level (FIG. 5(*b*)), the guard may prevent the frame lift from being moved under the vehicle.

SUMMARY OF THE INVENTION

It is an object of the invention to provide a vehicle jack which is free from the foregoing drawbacks of the conventional jacks.

Another object of the invention is to provide a vehicle jack which is particularly adapted to be used in pairs.

According to the invention, a vehicle jack is provided which comprises a base with means for moving the jack smoothly on a ground, an upright shell located on the base, an upright hydraulic ram located inside the shell and including a cylinder construction and a hollow rod, a vehicle support for directly supporting the bottom of a vehicle to be jacked up, a hydraulic source for raising the cylinder construction, and a locking means for mechanically preventing the cylinder construction from lowering from a raised position. The cylinder construction may include an outer cylindrical wall, an intermediate, slidable cylindrical wall capable of being extended upwardly from the rest of the cylinder construction and having openings through any one of which a pin may be inserted to fix the intermediate cylindrical wall at a required height, and an inner cylindrical wall defining an inner cylinder chamber. The hollow rod is located inside the inner cylindrical wall, and is fixed to the base at its bottom and defines an inner oil path which is in communication with the cylinder chamber. The hydraulic source is in communication with the oil path and supplies a hydraulic oil through the oil path into the cylinder chamber to raise the cylinder construction to lift up a vehicle with the vehicle support. The locking means, for example, may comprise a thread formed on an outer circumference of the outer cylindrical wall of the cylinder construction and an annular stopper provided around the outer cylindrical wall and having at an inner surface thereof a thread which is in engagement with the thread on the outer cylindrical wall.

BRIEF DESCRIPTION OF THE DRAWING

In FIG. 2(*a*) the vehicle jack is not loaded;

In FIG. 2(*b*) an intermediate cylindrical wall of a cylinder construction is extended upward from the rest of the cylinder construction;

FIG. 2(*c*) shows how the vehicle jack supports and jacks up a vehicle. However, in FIG. 2(*c*) no vehicle is shown;

DETAILED DESCRIPTION OF PREFERRED EMBODIMENTS

Figure 1:
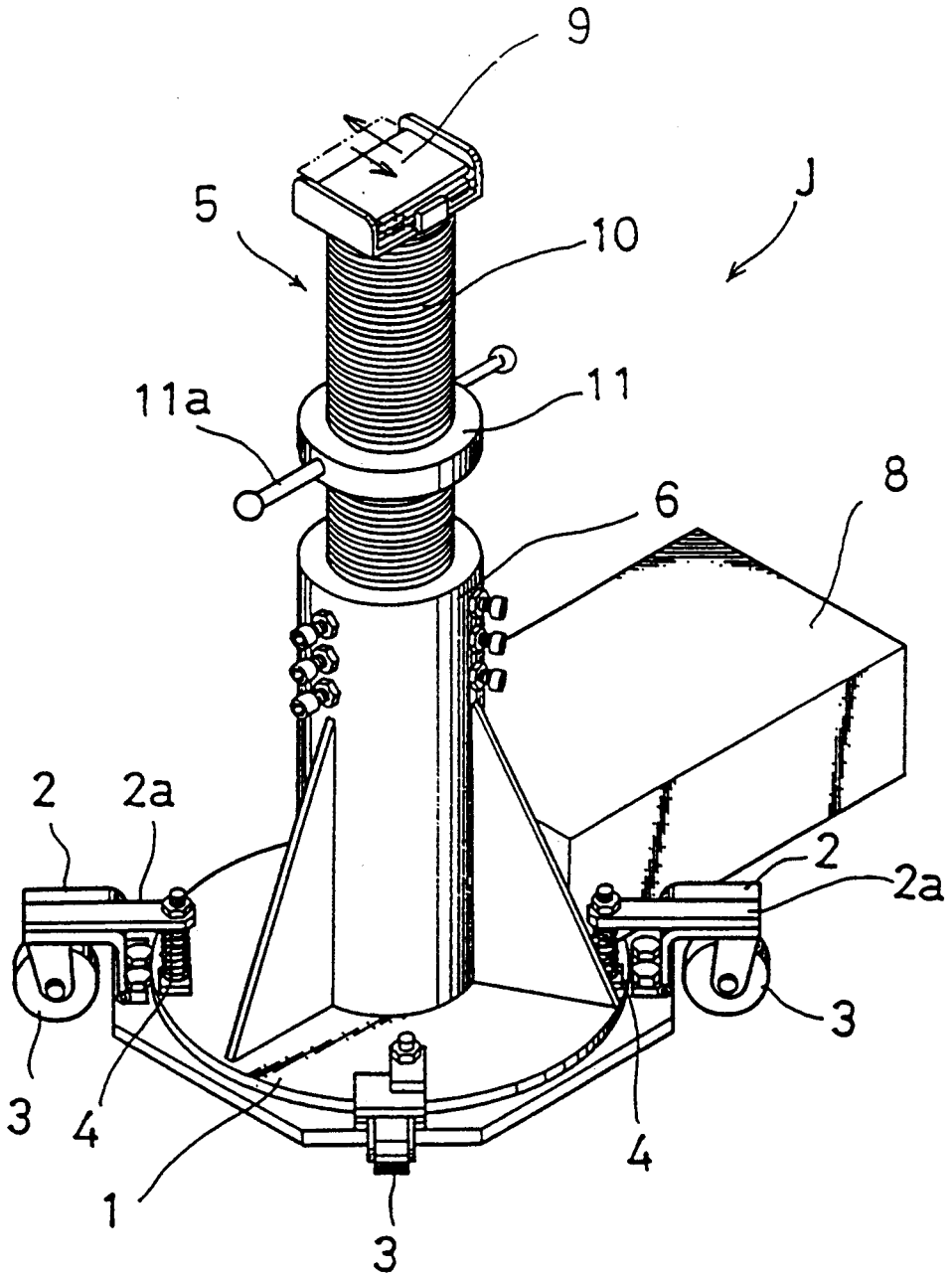
FIG. 1 is a perspective view of a vehicle jack of the invention.

A vehicle jack which embodies the invention in one preferred form will now be described with reference to the drawing.

Figure 2A:
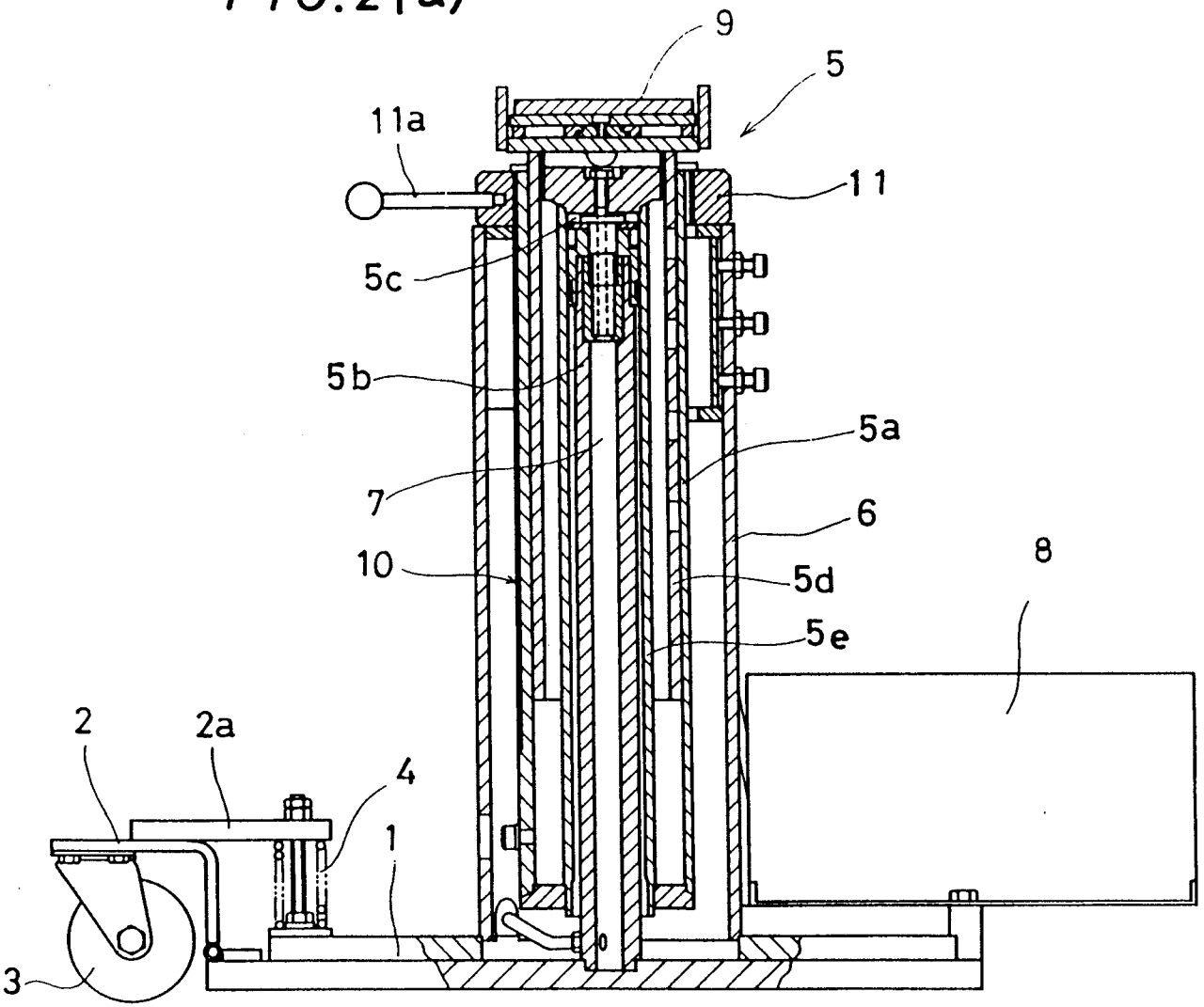
FIG. 2(*a*) shows the inner construction of the vehicle jack.
Figure 2B:
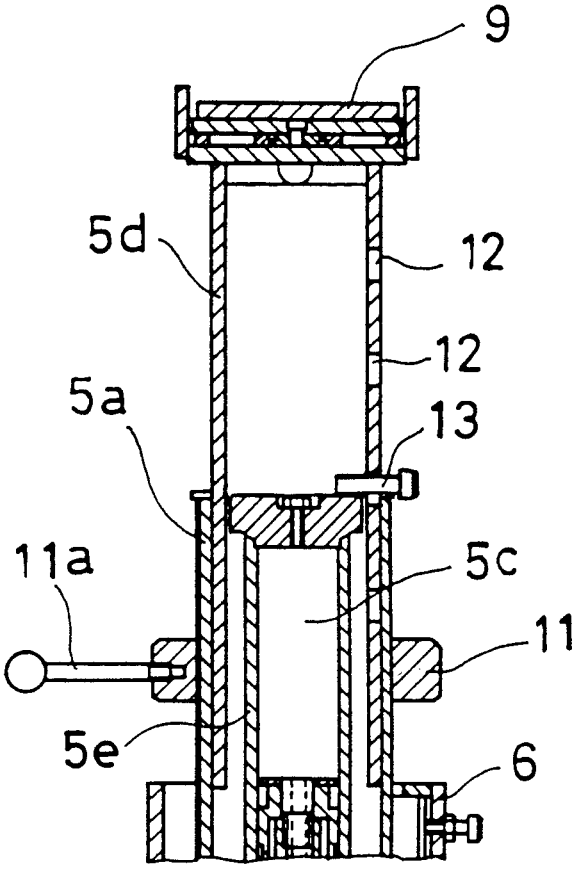
Figure 2C:
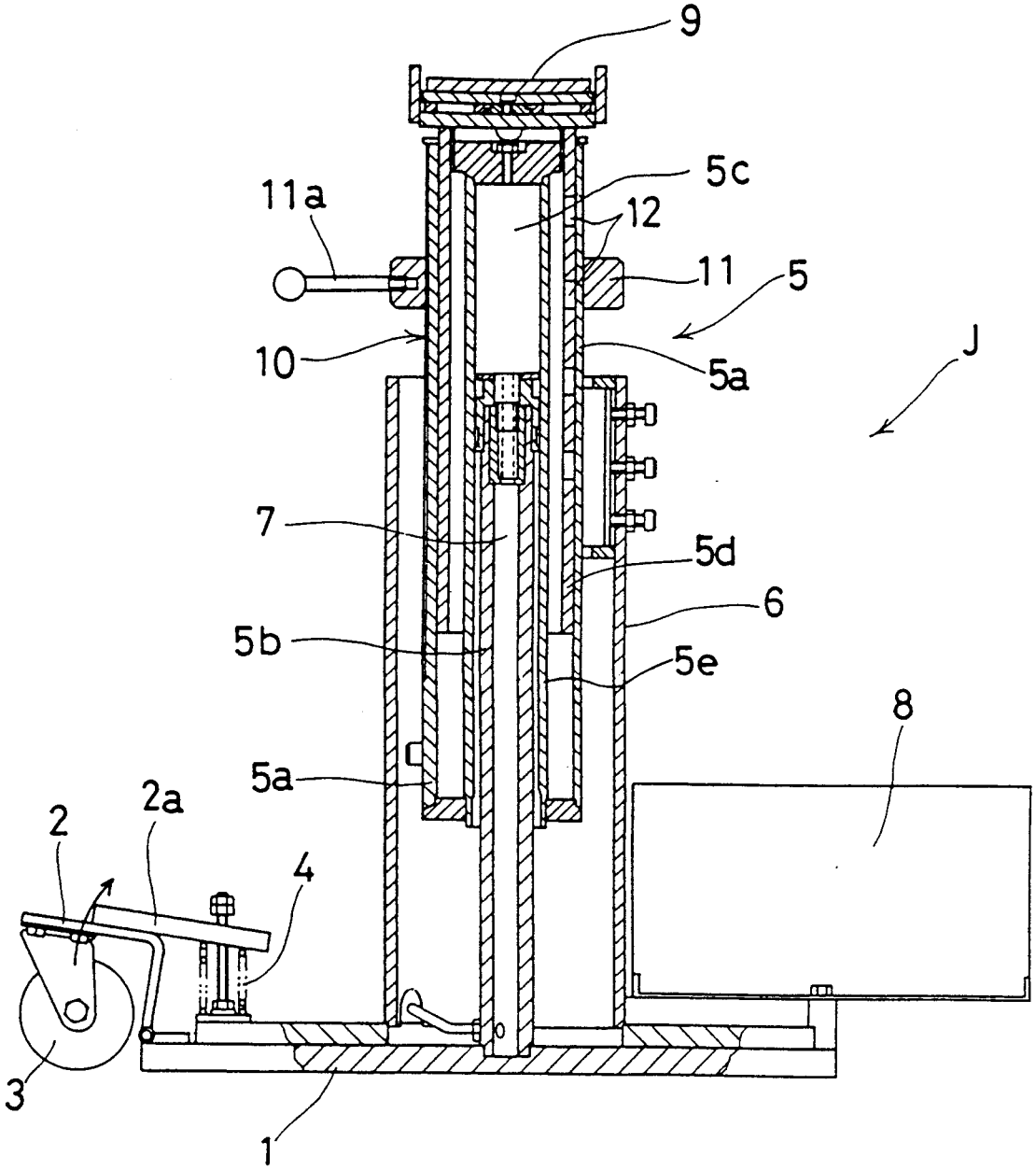

Referring to FIGS. 1 and 2(*a*) in particular, the vehicle jack J includes a base 1. Four inverted L-shaped mounts 2 are pivotally connected to the base 1. A castor 3 is provided below the horizontal portion of the mount 2. A compression spring 4 and a press member 2*a* are provided in conjunction with the mount 2. The press member 2*a* is in contact with the horizontal portion of the mount 2. The compression spring 4 is so provided as to urge the mount 2 in a clockwise direction (in FIG. 2(*a*)) through the press member 2*a*. When the mount 2 is being thus urged, the castor 3 is on the ground and the base 1 is slightly away from the ground.

An upright cylindrical shell 6 is located on the base 1. A hydraulic ram 5 is located inside the shell 6. The hydraulic ram 5 includes (i) a vertically-movable cylinder construction which consists of an outer cylindrical wall 5*a*, an intermediate, slidable cylindrical wall 5*d* and an inner cylindrical wall 5*e* and (ii) a hollow rod 5*b*. A vehicle support 9 for directly supporting the bottom of a vehicle is mounted on the top of the cylinder construction. The rod 5*b* is located inside the inner cylindrical wall 5*e*. The rod 5*b* is fixed to the base 1 at its bottom, and has an inner space, or oil path, 7. The oil path 7 is in communication with a cylinder chamber 5*c* defined by the inner cylindrical wall 5*e*.

A hydraulic source 8 is located adjacent to the shell 6. A hydraulic oil is supplied from the hydraulic source 8 into the oil path 7, and enters thence into the cylinder chamber 5*c* to move the cylinder construction upwardly (FIG. 2(*c*)).

The outer cylindrical wall 5*a* is provided with a thread 10 at its outer circumference. An annular stopper 11 is provided around the outer cylindrical wall 5*a*. The stopper 11 is provided at its inner cylindrical surface with a thread which is in engagement with the thread 10 of the wall 5*a*. The stopper 11 is also provided with handles 11*a* which can be held to rotate the stopper 11. When the stopper 11 is rotated, the stopper 11 is moved downward or upward while the thread thereof is in engagement with the thread 10 of the wall 5*a*.

When the jack J is not loaded, the castors 3 are on the ground and the base 1 of the jack is slightly away from the ground (FIG. 2(*a*)). Thus, the castors 3 enable the jack to be moved freely on the ground. In use, the jack is moved from the front or rear of a vehicle (to be jacked up) or from one of the sides thereof to a position directly below the point of the vehicle bottom at which the vehicle is to be jacked up. Then, the hydraulic source 8 is operated to move the cylinder construction upwardly (FIG. 2(*c*)). When the vehicle support 9 has come into contact with the bottom of the vehicle, the weight of the vehicle loaded on the jack cause the mounts 2 to pivot against the action of the spring as indicated by an arrow of FIG. 2(*c*), thereby lifting the castors 3 up away from the ground and placing the base 1 on the ground. When the vehicle has been jacked up to a required height, the stopper 11 is rotated to lower it until it comes into contact with the shell 6. Thus, if by any chance the hydraulic pressure should be reduced when the vehicle is in a lifted position, the cylinder construction will not lower. It ensures the safety with which the vehicle is taken care of in the lifted position.

The vehicle support 9 is slidable in two opposite directions as indicated by arrows of FIG. 1. Thus, if a greater weight is loaded on one of two opposite sides of the support 9 (corresponding to the foregoing two opposite directions) than on the other side thereof when the vehicle is being lifted, the support 9 will slide to the heavier side to prevent the jack from inclining.

Figure 3:
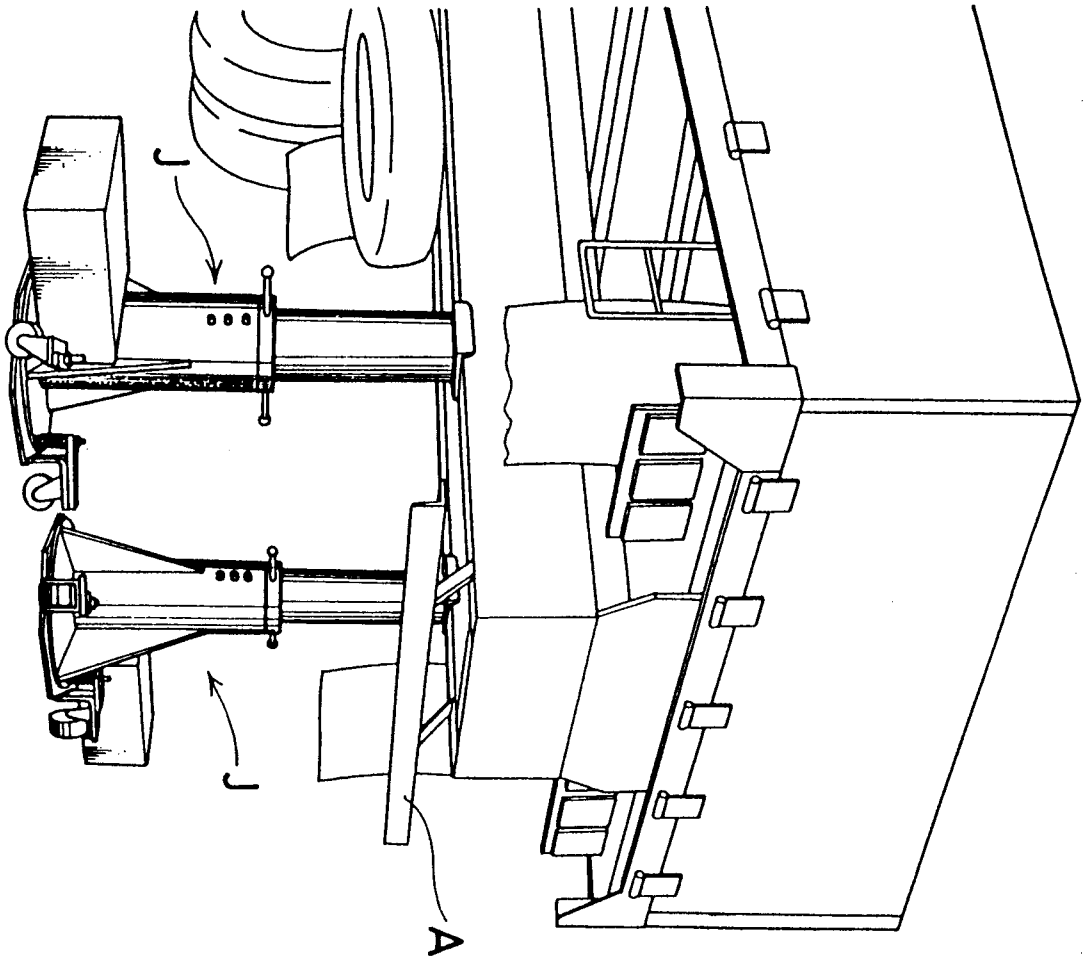
In FIG. 3 the vehicle jack is used in pairs.

The jack of the invention is particularly adapted to be used in pairs, as shown in FIG. 3. If one uses the jack in pairs, he is able to jack up a vehicle more safely than otherwise.

The intermediate, slidable cylindrical wall 5*d* of the cylinder construction is provided with openings 12. If desired, before the cylinder construction is raised, the cylindrical wall 5*d* may be extended upward from the rest of the cylinder construction, as shown in FIG. 2(*b*), to reduce the distance by which the cylinder construction is to be raised to support a vehicle. A pin 13 may be inserted through one of the openings 12 to fix the cylindrical wall 5*d*.

Figure 4:
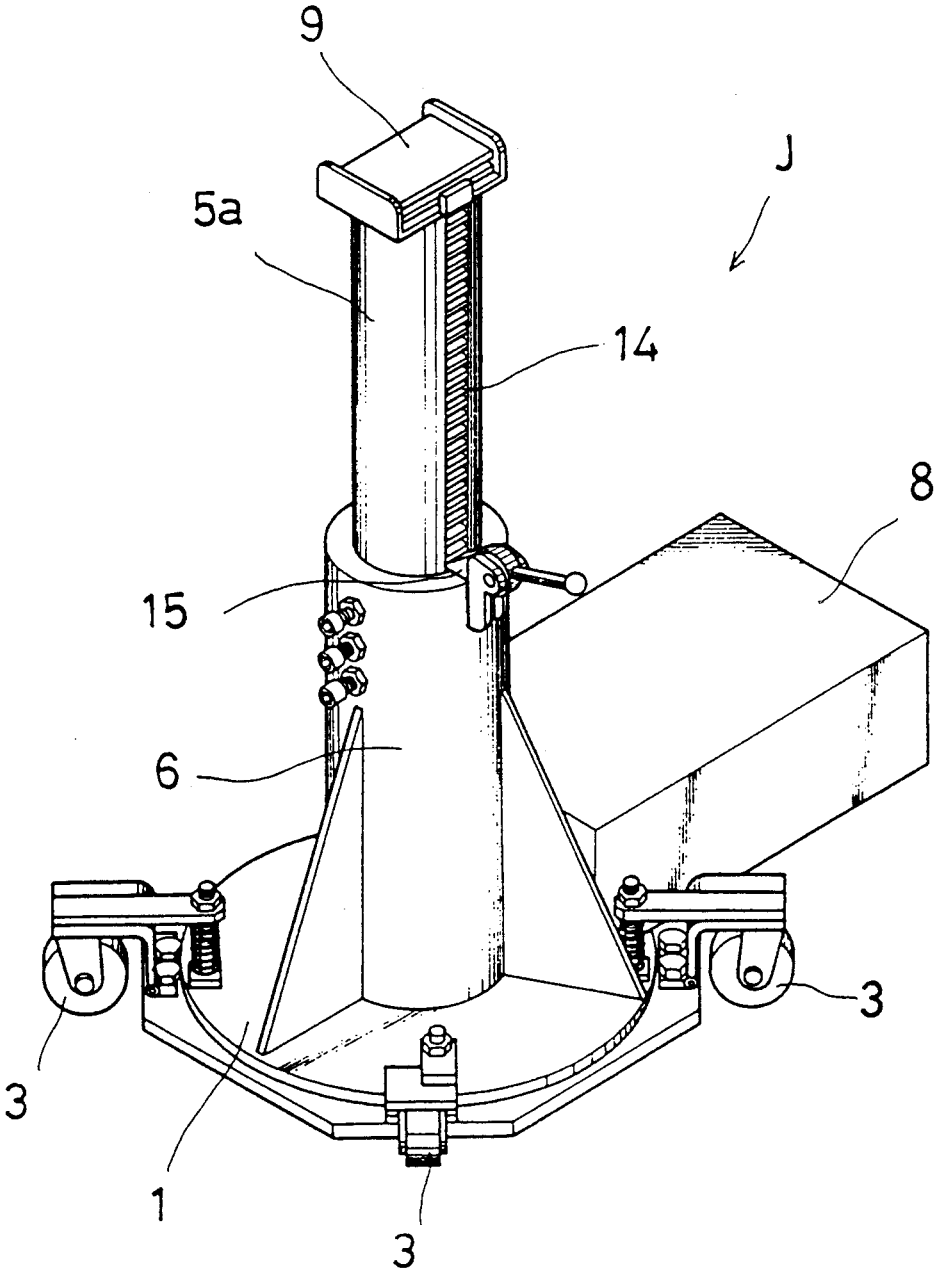
FIG. 4 shows a variation of a locking means.
Figure 5:
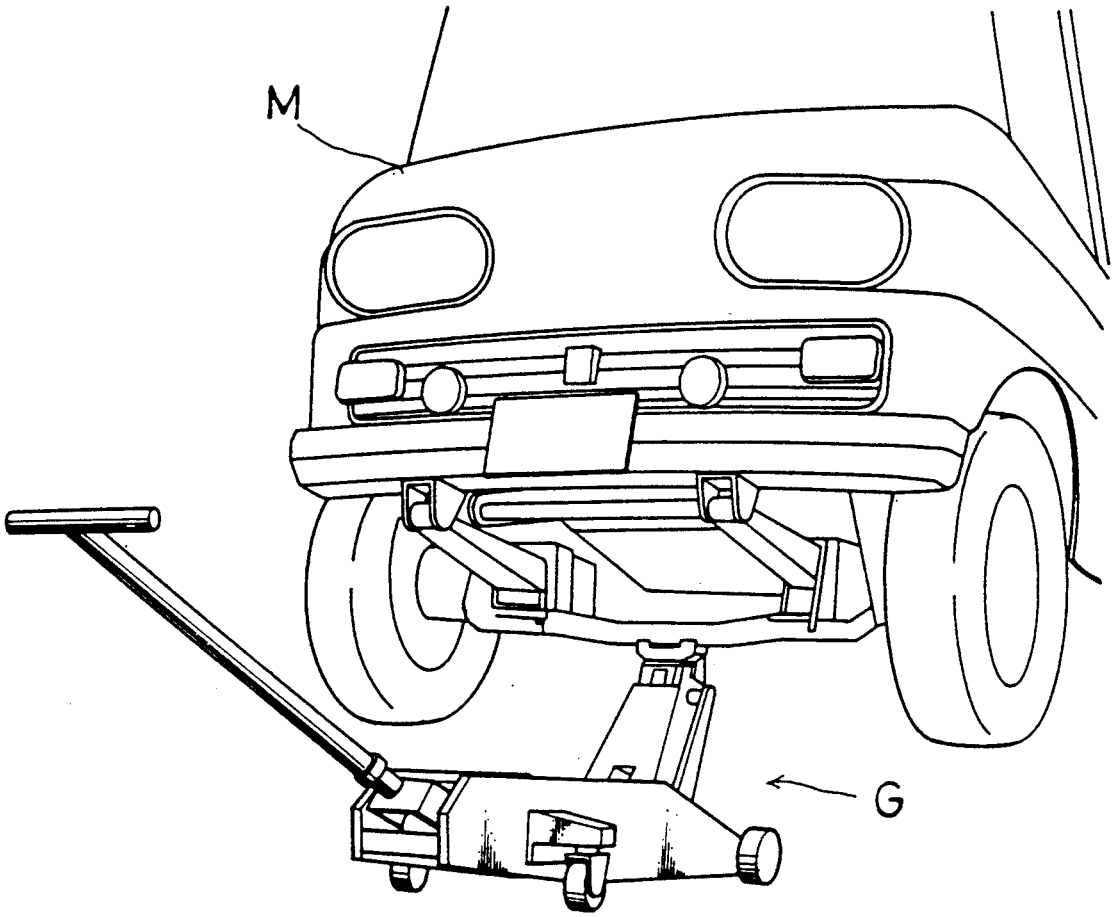
FIG. 5 (a) PRIOR ART
FIGS. 5(*a*) and 5(*b*) show two different types of conventional vehicle jacks.
Figure 5:
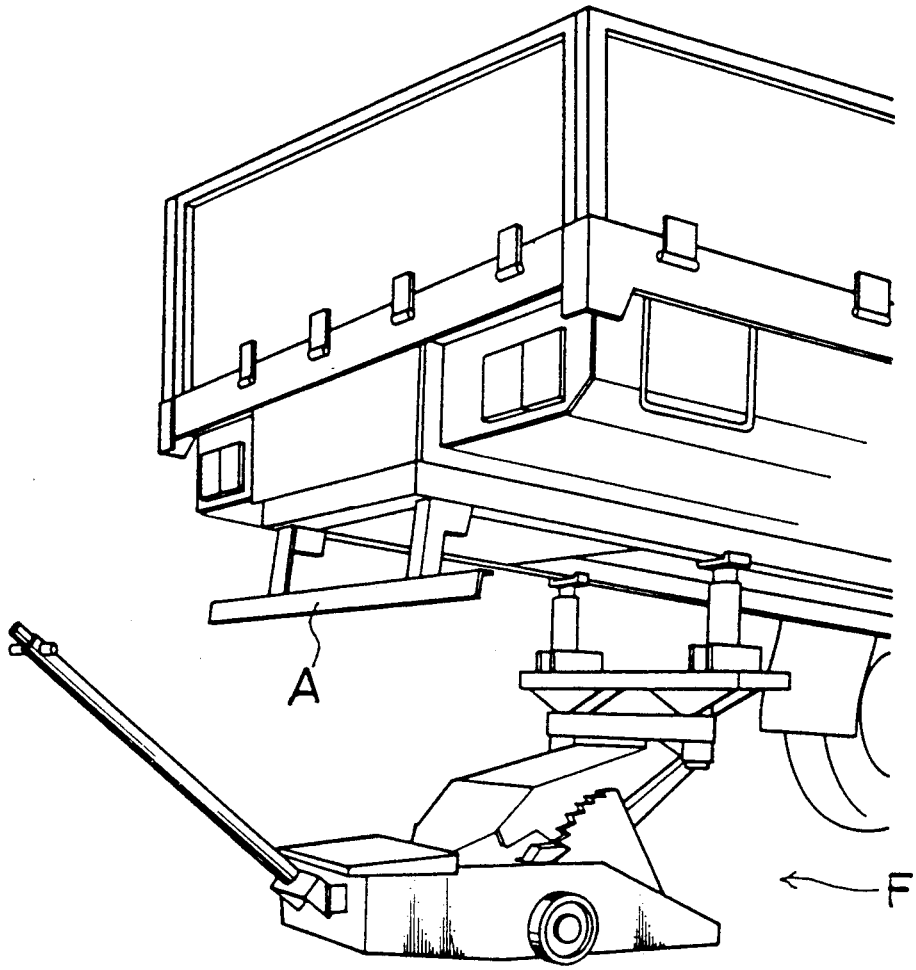
FIG. 5 (b) PRIOR ART

If desired, the thread 10 on the outer cylindrical wall 5*a* and the annular stopper 11 may be omitted and instead a corresponding mechanism of FIG. 4 may be used. That is, a locking means for mechanically preventing the cylinder construction from lowering from a lifted position may comprise a rack 14 formed on the outer cylindrical wall 5*a* and a click 15 connected to the top of the shell 6 for engaging with the rack 14. Also, if desired, as in the case of the intermediate cylindrical wall 5*d*, openings through which a pin can be inserted may be provided through the outer wall 5*a* (not shown).

In the foregoing embodiment the hydraulic source is located on the base 1. However, if desired, it is possible to use a hydraulic source located in a position remote from the base 1 and connected to the hydraulic ram 5 through an oil path.

Moreover, if desired, the vehicle support 9 may be replaced with an elongate support member having a pair of opposed means for directly supporting the bottom of a vehicle (not shown).

What is claimed is:

1. A vehicle jack comprising (a) an upright hydraulic ram having a cylindrical construction including a hollow rod defining an oil path, and an inner cylindrical wall having an axis and defining an inner cylinder chamber, wherein said oil path is in communication with said inner cylindrical chamber to hydraulically move said inner cylindrical wall axially when said jack is in operation, (b) an intermediate, cylindrical wall slidably mounted with said inner cylindrical wall and adapted for adjustable axial extension therefrom to a selected height, said intermediate cylindrical wall having means for selectively fixing said intermediate cylindrical wall at the selected height relative to said inner cylindrical wall, said intermediate cylindrical wall further having a vehicle support, (c) an outer cylindrical wall axially movable with said inner cylindrical wall, (d) an upright shell surrounding said outer cylindrical wall, (e) a base supporting said shell and said cylindrical construction, said base having means for moving said jack on a surface, (f) locking means selectively engaged with said outer cylindrical wall for locking it, and thereby said inner cylindrical wall, axially relative to said upright shell, and (g) a hydraulic source, in communication with said oil path, for supplying hydraulic oil through said oil path into said inner cylinder chamber for operating said ram.

2. A vehicle jack in accordance with claim 1 wherein said locking means comprises a thread formed on an outer circumference of the outer cylindrical wall of the cylinder construction and an adjustable annular stopper provided around the outer cylindrical wall and having at an inner surface thereof a thread which is in engagement with the thread on the outer cylindrical wall, wherein said locking means is adapted for manual rotation to rest against said outer shell, thereby preventing said ram from lowering.

3. A vehicle jack in accordance with claim 1 wherein said locking means comprises a rack formed on an outer surface of the outer cylindrical wall of the cylinder construction and a click connected to the shell for engaging with the rack to automatically lock said jack in the raised position.

4. A vehicle jack in accordance with claim 1 wherein said locking means comprises openings provided through the outer cylindrical wall of the cylinder construction and a pin adapted for insertion through any one of the openings of the outer cylindrical wall to rest on said outer shell, thereby preventing said ram from lowering.

* * * * *